US005924475A

United States Patent [19]

Beckwith et al.

[11] Patent Number: 5,924,475

[45] Date of Patent: Jul. 20, 1999

[54] METHOD OF MAKING GAS CURABLE RESIN-COATED SAND CORES

[75] Inventors: Elaine Cecilia Beckwith, Northville; James Stewart Rankin, II, Novi; Warren Benjamin Copple, Trenton, all of Mich.

[73] Assignee: Ford Global Technologies, Inc., Dearborn, Mich.

[21] Appl. No.: 08/851,289

[22] Filed: May 5, 1997

[51] Int. Cl.[6] ..... B22C 9/10; B22C 1/02

[52] U.S. Cl. ..... 164/456; 164/16

[58] Field of Search ..... 164/456, 12, 16

[56] References Cited

U.S. PATENT DOCUMENTS 5,655,592 8/1997 Sullivan ..... 164/456

*Primary Examiner*—Kuang Y. Lin
*Attorney, Agent, or Firm*—Joseph W. Malleck

[57] ABSTRACT

A method of making sand cores to obtain optimum mechanical properties and particularly to obtain accurate adjustment of the gas curing cycle for making optimum resin-coated sand cores. The method comprises blowing, into a core box cavity, mixture of core making particulated sand and gas curable liquid resin having a first level of pH, such mixture containing a uniform distribution of a pH indicating dye additive that changes color in response to a change in pH level, in contact therewith, such blowing being continued to fill the cavity to a desired density and form an uncured sand core shape with a predetermined porosity, (b) introducing a catalyst gas having a second level of pH, through the pores of the core shape to cure the resin and contact the dye additive, (c) concurrently, or subsequent to step (b), sensing the degree of color change of any part of the core shape that is or has taken place as a result of exposure to the flow front of the catalyst gas, and (d) responding to such color sensing to modify the parameters of catalyst gas introduction (i.e. exposure time, gas pressure, gas concentration or gas inlet/out location) to ensure the desired degree of catalyst reaction in the desired time period.

7 Claims, 4 Drawing Sheets

METHOD OF MAKING GAS CURABLE RESIN-COATED SAND CORES

TECHNICAL FIELD

This invention relates to the technology of making resin-coated sand cores useful in making metal castings, and more particularly to technology that assures complete core curing of the resin-coated sand within a core box within the shortest possible time.

DISCUSSION OF THE PRIOR ART

The cold box process of making bonded sand cores is well known and uses a gas or vaporized catalyst to cure the resin-coated sand while the catalyst is in contact with the sand at room temperature within a closed core box. It remains a problem how to determine whether a consistent and sufficient concentration of the catalyst has permeated the different parts of the core to react with the resin coating while held in such closed core box. Without precise knowledge of the catalyst flow front and concentration which may vary with time, an operator cannot know whether the catalyst gas has fully penetrated the entire core body, risking core defects, such as spongy core areas, or areas that are so brittle that they easily break or fall away during subsequent handling. Moreover, the operator cannot know precisely when to open the core box, thereby risking not only exposure of the operator to noxious catalyst gases if the resin has not been properly cured or thereby risking an improperly bonded sand core leading to high rates of scrap.

To Applicant's knowledge, there is no known method to detect, measure and monitor the concentration of the catalyst flow front in the core box and the degree to which the catalyst gas has penetrated the core body. The operator either can err on the side of excess cycle time to fully ensure that the catalyst gas has migrated sufficiently and completed its curing job even at low unintended concentrations. As a result, shortened time cycles are not possible for the cold box process.

An example of a poorly cured sand core is one that is cured on its outer surface but not cured sufficiently inside. It will not have the proper handleability and will break in subsequent core assembly steps. If such defective core is not detected before hot metal is cast against it, the core will deform during casting. As a consequence, the expensive metal casting must be scrapped or the metal casting must be subjected to expensive grinding to remove excess metal that represents a wrong geometry (areas filled with metal that are supposed to be open passageways).

Certainly batch techniques which, over a long period of time, gather a detectable gas sample and which take an even longer period of time to analyze the sample by use of wet chemicals requiring titration, cannot give information that would aid in telling the extent of gas permeation or that would aid in shortening the cycle time of core box usage. Other prior techniques that monitor the total mass of gas, entering at the inlet to the core box, fail to enable an understanding of how the catalyst gas flow front is affecting the sand core in any given case, and therefore there is no knowledge as to what is happening within the cold box core process.

SUMMARY OF THE INVENTION

It is an object of this invention to provide a technique for the cold box process that allows the degree of advancement of the flow front of the catalyst gas to be accurately determined or observed for each set of conditions (gassing concentration, gassing pressure, gas volume, gas temperature, corebox sealing, and gassing inlet and outlet locations). Such ability to observe or determine will lead to reduced core defects, reduced casting scrappage and better design of the core boxes.

The invention herein that meets such object is a method of making sand cores to obtain optimum mechanical properties, and particularly to obtain accurate adjustment of the gas curing cycle for making optimum resin-coated sand cores. The method comprises (a) blowing into a core box cavity a mixture of core making particulated sand and gas curable liquid resin having a first level of pH, such mixture containing a uniform distribution of a pH indicating dye additive that changes color in response to a change in pH level in contact therewith, such blowing being continued to fill the cavity to a desired density and form an uncured sand core shape with a predetermined porosity, (b) introducing a catalyst gas having a second level of pH, through the pores of the core shape to cure the resin and contact the dye additive, (c) concurrently, or subsequent to step (b), sensing the degree of color change of any part of the core shape that is or has taken place as a result of exposure to the flow front of the catalyst gas, and (d) responding to such color sensing to modify the parameters of catalyst gas introduction to ensure the desired degree of catalyst reaction in the desired time period.

DETAILED DESCRIPTION AND BEST MODE

Figure 1:
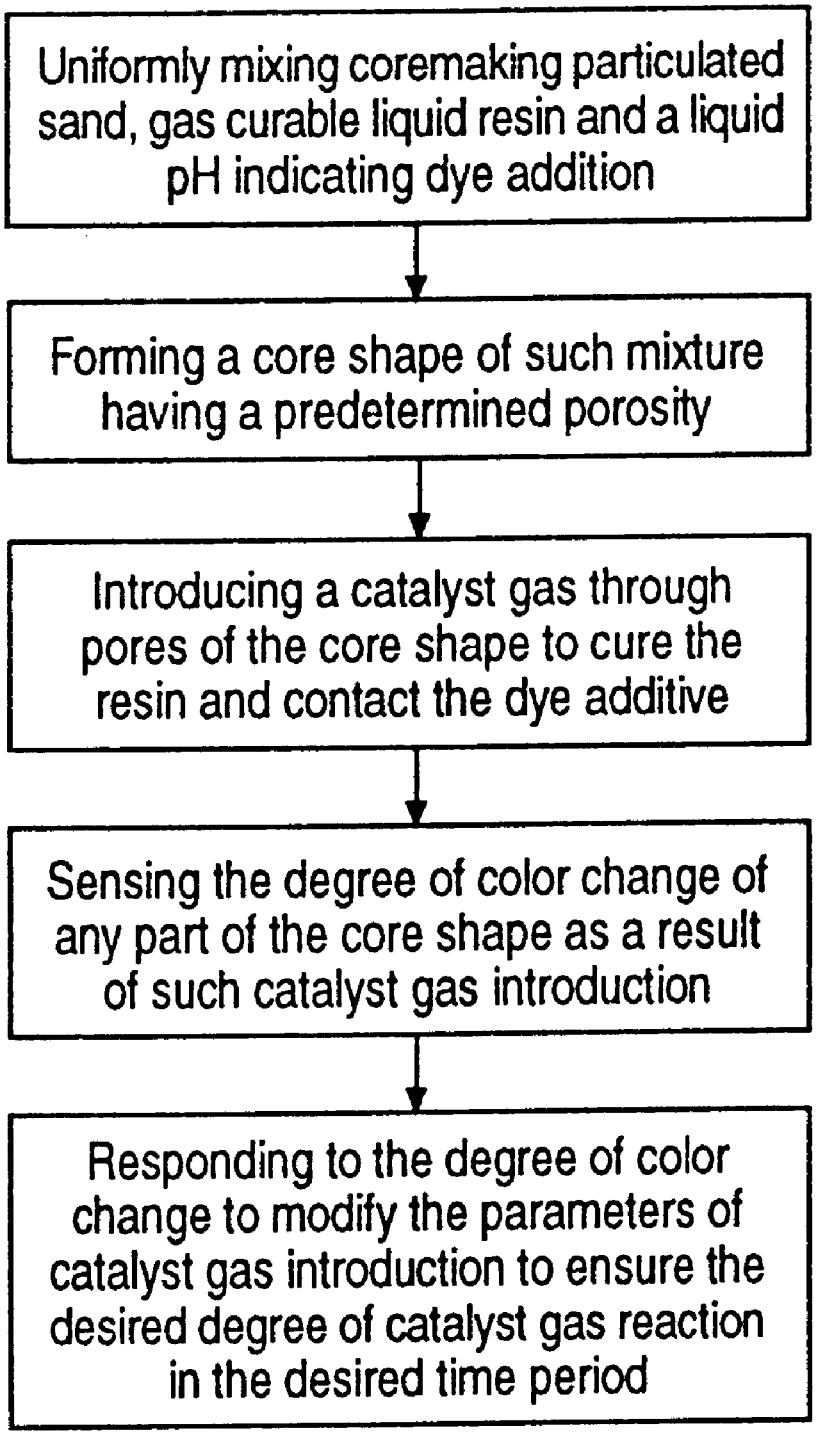
FIG. 1 is a block diagram of the steps of this invention.

As shown in FIG. 1, the method of this invention comprises the steps of (1) homogeneously distributing a curing indicating dye throughout a supply of resin-coated sand to form a treated mixture, (2) forming the treated mixture into a core shape with controlled porosity, (3) introducing or forcing a catalyst gas through the core to cure the resin, (4) observing the extent to which the distributed dye has changed in color, and (5) responding to the color change to adjust the parameters of catalyst gas introduction if needed.

Material for the cold box process is prepared for purposes of this invention by adding a pH sensitive dye 30 (as the curing indicator) to a mixture 34 of particulated core making sand 31 and gas curable liquid resin 32. The resin can be selected from the group of phenolic urethane, phenolic $CO_2$, sodium silicate $CO_2$, furan $SO_2$, acrylic epoxy $SO_2$, having a pH in the range of 2–9. The dye is selected to exhibit a first color when exposed to the resin 32 (which possesses a first level of pH), and change to a distinctly different color when exposed to a catalyst gas 33 (having a different pH level) that attempts to permeate the mixture 34 during step (3). The dye can be selected from sulfone phthaleins which are sensitive to a change in pH within a range of 2–10.

Core making sand 31 is usually silicon lake sand with an average particle size of 200–300 microns. Other types of sand or refractory grains can be used, such as zircon. The resin 32 for the sand mixture is preferably a liquid phenolic urethane carried in a solvent, the phenolic urethane having separate hydroxyl and isocyanate functionality which react in the present of an amine catalyst (i.e., triethylamine) to produce a solid binder in the form of urethane. Other binder resins may include furan resins, epoxy resins, and polyesters, all of which depend upon hydrocarbon bonds, oxygen-carbon bonds, or nitrogen-carbon bonds when cured. The phenolic urethane resin usually has a pH in the range of 2–6, whereas furan resins may have a pH level in the range of 2–5.

The curing indicating dye (pH sensitive additive), is selected so that a distinct first color 35 in the presence of the resin will change to a distinctly different color 36 when exposed to the catalyst gas that is brought into contact therewith. For this to occur, the additive is uniformly distributed throughout the treated mixture 34 so that any one particle of dye exposure to the catalyst gas will occur at the same time as an adjacent particle of resin is exposed to such catalyst gas. The indicating dye, for example, may consist of aqueous dispersion of bromocresol green dye, wherein such dye is yellow or brown (color 35) in the presence of the predominantly acidic resin sand mixture (pH of 2–6) and turns blue (color 36) when the catalyst gas (triethylamine) contacts it, the catalyst gas having essentially a more basic pH of greater than 5 but less than 11. The indicating dye dispersion 37 is prepared so that it is formed as a water solution with the dye being present in the dispersion in an amount of 0.5 to 1.5% by weight, preferably about 1.1% by weight. The dispersion or solution in turn is added to the resin-coated sand mixture in an amount of amount 0.5–1.0% by weight of the resin sand mixture. This is an extremely small amount and steps must be taken to ensure that the dye is uniformly distributed throughout the treated mixture. To this end, the resin-coated sand is prepared by introducing the sand, as well as the liquid resin, into a mixing device 38, such as a muller, which utilizes stainless steel rollers in a stainless steel container to mix the contents therein.

Figure 2:
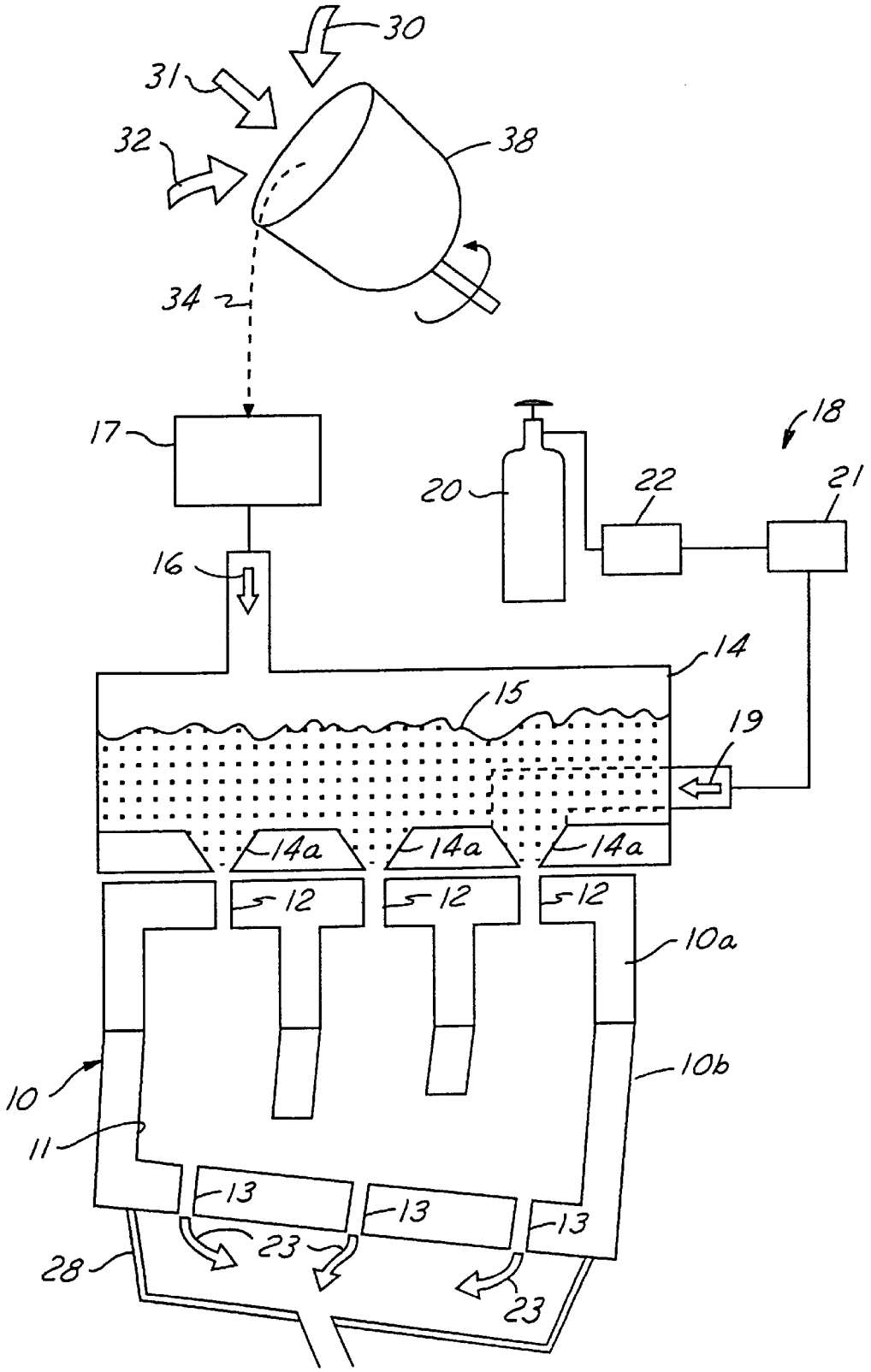
FIG. 2 is a schematic illustration of an apparatus (partly in cross-section) used to carry out the method of this invention.

Utilizing such treated mixture 34, the cold box process will then consist of four steps: blowing the treated mixture into a core box, gassing the contents therein, purging the core box contents of gas and removing the bonded core. As shown in FIG. 2, a core box 10, having upper and lower box portions 10(*a*) and 10(*b*) define an internal cavity 11 with one or more small inlets 12 and one or more screened outlets 13. To effect blowing of the treated mixture, a fluidizing chamber or sand magazine 14 is placed on top of the core box and has conically shaped portions 14(*a*) in communication with each inlet 12 to the core box. The resin-coated sand mixture 34 (containing the dye), in a predetermined volume, is introduced to the chamber 14 to a level 15 such as illustrated; a supply of fluidizing gas 16, such as pressurized air at about 80 psig from a supply 17, is admitted into the chamber 14 to create an air/sand mixture suspension which then flows into the inlets 12 packing the cavity 11 with the sand mixture while the fluidizing gas migrates through the sand to exit through the screened outlets 13.

The gassing step is effected by stopping the flow of fluidizing air 16, removing the fluidizing chambers or sand magazine 14 from the top of the core box (which box cavity has now been packed with sand) and placing a catalyst-purging apparatus 18 in communication with the inlets 12, the inlets having a throat area of at least 0.25 inches and a spacing between the inlets of no greater than 7 inches. Pressurized amine catalyst gas 19 is released from a supply 20 by operation of shut-off valve 21 and regulation of the pressure of the amine gas is carried out by way of pressure regulator 22 promoting a pressure of at least 2 psig, preferably about 5 psig. The curing gas migrates 30 through the interstices (porosity) of the defined sand core to eventually exit from outlets 13 as an effluent 23. The preferred time period for curing is in the range of 1–30 seconds for completion. Although the mass of gas needed to cure the resin can be readily determined using stoichiometric data, an operator is never completely certain that such determined mass is sufficiently high enough in concentration and at the right pressure and gassing time and temperature for the given geometry of the core shape and outlet sizing, as well as the inlet/outlet placement, to permit the curing gas to fully do its job. The outlet sizing permits part of the curing gas to escape during curing and must be compensated. The amount of curing gas lost during curing is also dependent upon the integrity of the sealing of the core box parts; often under-gassing or overgassing occurs. It is typical to inject about 2–10% by weight of triethylamine gas into the carrier gas, such as nitrogen, which nitrogen is flowing at a rate of about 2–20 liters per minute. The catalyst gas can be selected from the group of amine ($SO_2$), sulfur dioxide and carbon dioxide ($CO_2$).

Either during the step of introducing the catalyst gas through the core box or subsequent thereto, observation is made as to the extent of color change of the core shape due to the flow front of the permeating catalyst gas. The operator can be certain that the catalyst has traveled through the entire core by observing the completeness of color change from yellow to blue in all areas. Areas that remain yellow or that are not a strong blue color are inadequately cured.

Figure 3A:
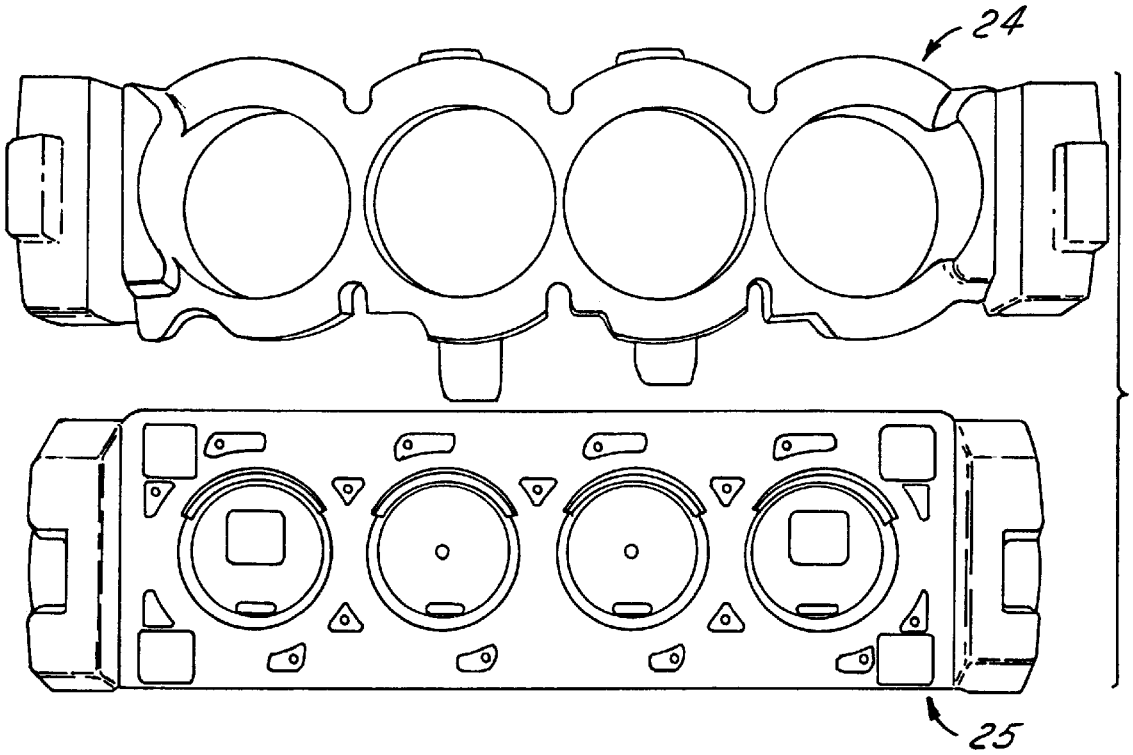
FIGS. 3*a*, 3*b* and 3*c* show some of the internal sand cores (prepared by the method of this invention) that are traversed to form a complex metal casting, such as an automotive engine block.
Figure 3B:
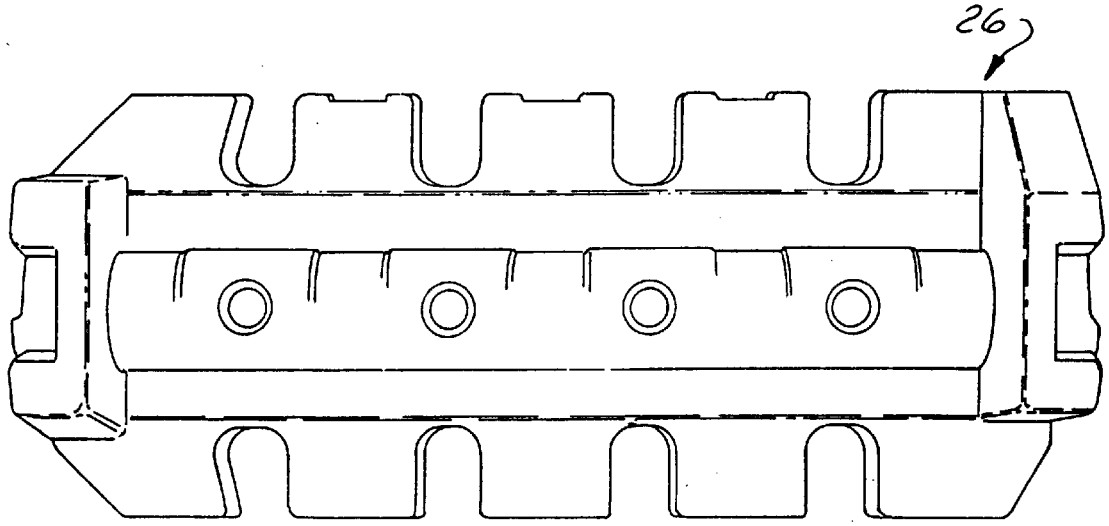

Considerable handling, assembly and interlocking is necessary for the sand cores to be used in the making of a metal casting. The complexity and size of some of such cores (cores 24–27) are illustrated in FIGS. 3*a,* 3*b* and 3*c* for use in the casting of an automotive engine block. If such cores are to serve their purpose, the cured core must have a glass transition temperature (Tg) of about 70° C. when phenolic urethane resin is used. The glass transition temperature is the temperature where there is increased molecular mobility of the polymer resin. This mobility results in significant changes in the mechanical properties of the cured resin system. Without a Tg, the core is brittle and will not have the compressive strength to be handled in the metal casting process; the core will not be able to adequately withstand the metal pouring operation and may result in the scrapping of very expensive metal castings.

Figure 4:
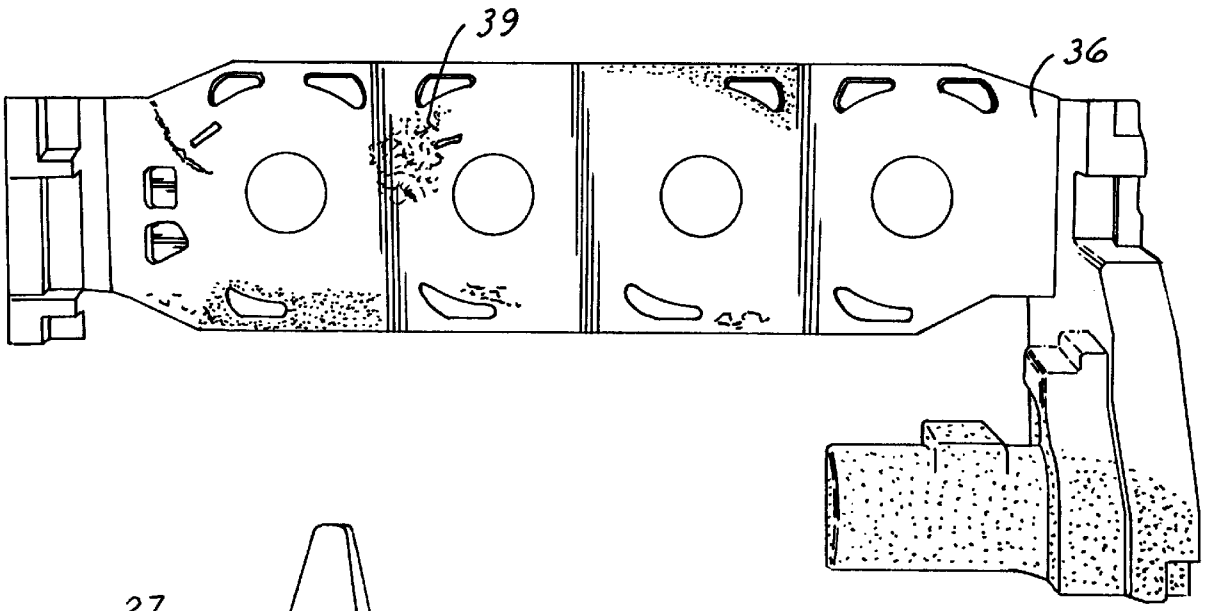
FIG. 4 is a plan view of one of the cores of FIG. 3 that exhibits partially defective curing of one type revealed by the color dye.
Figure 5:
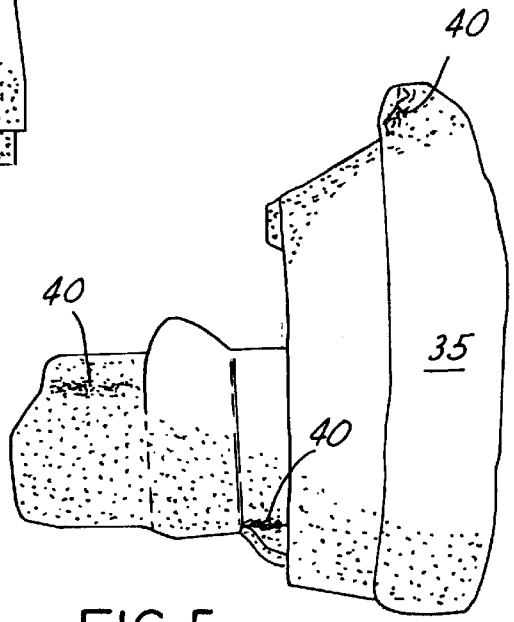
FIG. 5 is a view of another core portion for the same core shape, which exhibits defective curing of another type leading to even greater defects.
Figure 3C:
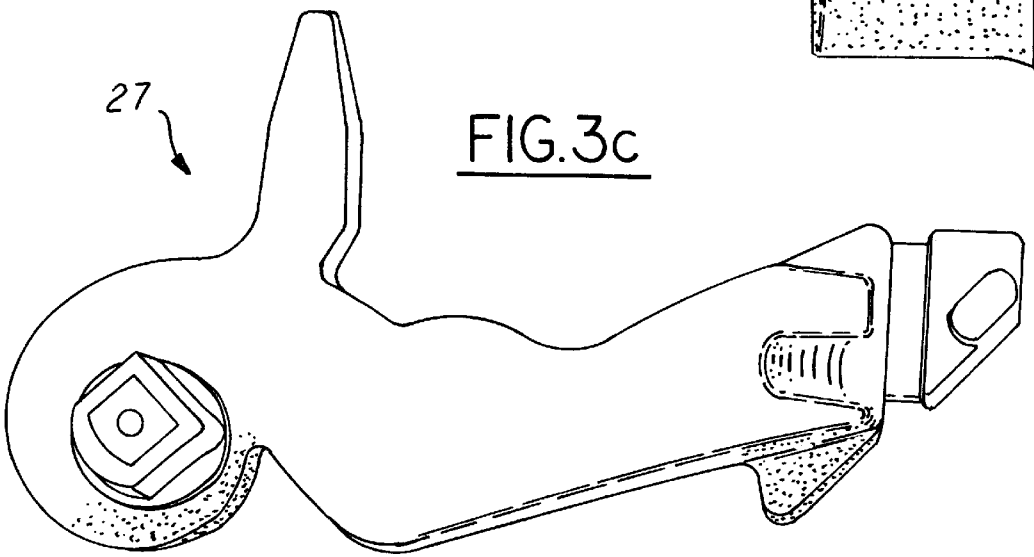

One of the cores, a head deck slab core, prepared and cured with the use of the indicating dye of this invention, is shown in FIG. 4. This example illustrates subtle imperfections that can be observed by the operator. Areas where the catalyst did not permeate are still in tan color 35 or a blend of tan and green (see those marked with arrows). These areas have not been cured properly and will have weak mechanical properties. An example of an inadequately cured core with more pronounced defects is shown in FIG. 5. It is a part of the head deck slab core shown in FIG. 4, such part having been broken off when ejected from the core box machine. It possessed spongy areas shown at 39 and broken off sections at 40.

As the last step of the method herein, the operator responds to incomplete color changes by adjusting one or more of the catalyst gas parameters, such as: (i) changing the concentration of catalyst gas that is forced through the core box, preferably by increasing such concentration by increments of 0.1%, (ii) changing the pressure of the catalyst gas from 2 to 20 psig, (iii) relocating the inlets 12 and/or outlets 13 for the conveyance of the catalyst gas 19 to be more readily distributed throughout the more difficult sections of the porous core, and (iv) changing the size of the catalyst gas inlets or outlets to promote increased or decreased gas flow therethrough. Other parameters that may also be changed include gas temperature or time of gassing.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of accurately adjusting the gas curing cycle for making resin-coated sand cores, comprising:

(a) blowing into a core box cavity a mixture of core-making particulated sand and gas curable liquid resin having a first level of pH, such mixture containing a uniform distribution of a pH indicating dye additive that changes color in response to a change in pH level in contact therewith, such blowing being continued to fill said cavity to a desired density and form an uncured sand core shape with a predetermined porosity;

(b) introducing a catalyst gas having a second level of pH, throughout the pores of said core shape to cure said resin and contact the additive, which cured resin bonds and strengthens the core shape;

(c) concurrently, or subsequent to step (b), sensing the degree of color change of any part of the core shape that is or has taken place as a result of exposure to the flow front of the catalyst gas; and (d) responding to such color sensing to modify the parameters of catalyst gas introduction to ensure the desired degree of catalyst reaction in the desired time period.

2. The method as in claim 1, in which the liquid resin is selected from the group of phenolic urethane, phenolic $CO_2$, sodium silicate $CO_2$, furan $SO_2$, acrylic epoxy $SO_2$ having a pH in the range of 2–9.

3. The method as in claim 1, in which said pH indicating dye additive is selected from sulfone phthaleins, such indicator being sensitive to a change in pH within a range of 2–10.

4. The method of claim 1, in which the catalyst gas for curing the resin is selected from the group of amine ($SO_{2)}$, sulfur dioxide or carbon dioxide ($CO_2$).

5. The method as in claim 1, in which said pH indicating dye additive is introduced as a aqueous dispersion to the resin-coated sand mixture, the dye being present in the dispersion in an amount of 0.5 to 1.5% weight.

6. The method as in claim 1, in which the desired time period is in the range of 1–30 seconds for the completion of curing in step (b).

7. The method as in claim 1, in which said catalyst gas is introduced to the core shape at a plurality of inlet locations, each location having a throat area of at least 0.25 inches, and the spacing between such inlets being no greater than 7 inches, and the gas being introduced at a pressure of at least 2 psig.

* * * * *